US006807390B2

(12) United States Patent
Suda et al.

(10) Patent No.: US 6,807,390 B2
(45) Date of Patent: Oct. 19, 2004

(54) IMAGE FORMING APPARATUS

(75) Inventors: Takeo Suda, Tokyo (JP); Shinichi Kawahara, Tokyo (JP); Masanori Kawasumi, Tokyo (JP); Ken Amemiya, Tokyo (JP); Hiroshi Ono, Tokyo (JP); Hiroshi Mizusawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/405,630

(22) Filed: Apr. 3, 2003

(65) Prior Publication Data

US 2003/0215259 A1 Nov. 20, 2003

(30) Foreign Application Priority Data

Apr. 12, 2002 (JP) ..... 2002-110248

(51) Int. Cl.[7] ..... G03G 15/02
(52) U.S. Cl. ..... 399/100
(58) Field of Search ..... 399/100, 168, 399/174, 175, 176, 299, 302, 303

(56) References Cited

U.S. PATENT DOCUMENTS

| | | | | |
|---|---|---|---|---|
| 5,842,081 | A | 11/1998 | Kaname et al. | |
| 5,950,062 | A | 9/1999 | Yahata et al. | |
| 6,055,388 | A | 4/2000 | Watanabe et al. | |
| 6,055,394 | A | 4/2000 | Suda et al. | |
| 6,085,062 | A | 7/2000 | Mizuishi et al. | |
| 6,101,351 | A | 8/2000 | Suda et al. | |
| 6,128,449 | A | 10/2000 | Zenba et al. | |
| 6,144,811 | A | 11/2000 | Ohori et al. | |
| 6,144,822 | A | 11/2000 | Yamaguchi et al. | |
| 6,148,161 | A | 11/2000 | Usui et al. | |
| 6,160,969 | A | 12/2000 | Ishigaki et al. | |
| 6,256,465 | B1 | 7/2001 | Yoshinaga et al. | |
| 6,266,501 | B1 | 7/2001 | Mizuishi et al. | |
| 6,336,013 | B1 | 1/2002 | Suda et al. | |
| 6,337,957 | B1 | 1/2002 | Tamaki et al. | |
| 6,463,237 | B2 | 10/2002 | Suda et al. | |
| 6,470,161 | B2 * | 10/2002 | Fujishiro et al. | 399/159 |
| 6,522,855 | B1 | 2/2003 | Katoh et al. | |
| 6,560,414 | B2 | 5/2003 | Suda et al. | |

FOREIGN PATENT DOCUMENTS

| | | |
|---|---|---|
| EP | 1 193 568 | 4/2002 |
| EP | 1 229 399 | 8/2002 |
| JP | 8-62949 | 3/1996 |
| JP | 08-123140 | 5/1996 |
| JP | 10-282854 | * 10/1998 |
| JP | 11-288150 | 10/1999 |
| JP | 2000-221756 | 8/2000 |
| JP | 2002-196568 | 7/2002 |
| JP | 2002-221883 | 8/2002 |

OTHER PUBLICATIONS

Patent Abstracts of Japan, JP 59–218479, Dec. 8, 1984.
Patent Abstracts of Japan, JP 2002–108069, Apr. 10, 2002.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a plurality of photoreceptors and an intermediated transfer body through which toner images on the photoreceptors are transferred to a recording medium. The image forming apparatus also includes charging members provided in contact with or adjacent to the respective photoreceptors, and further includes at least one cleaning unit that contacts the charging member and removes foreign substance from the surface of the charging member.

10 Claims, 4 Drawing Sheets

IMAGE FORMING APPARATUS

BACKGROUND OF THE INVENTION

1) Field of the Invention

The present invention relates to an image forming apparatus, and more particularly to a copier, a printer, and a facsimile using an electro-photographic process.

2) Description of the Related Art

An image forming apparatus charges a photoreceptor by a charging member, and forms a latent image using a laser light, and forms a toner image by developing the latent image using a toner that is not greater than 10 $\mu$m in grain size. The image forming apparatus transfers the toner image to a transfer paper, and registers the image on the transfer paper by fusing and fixing the image using a heat roller. If the charging member is provided in contact with or adjacent to the photoreceptor, an electric resistance of the charging member changes, because foreign substances adhere to a surface of the charging member as the charging member is used for a long time. Thereby, an abnormal image occurs due to an uneven charging, an insufficient charging, and a faulty charging. The foreign substances include residual toner on the photoreceptor, or paper powder produced from the transfer paper. The photoreceptor is provided with a photoreceptor cleaning unit to remove the foreign substances. However, if grains of the foreign substances are smaller or closer to round in shape, the foreign substances pass through the photoreceptor cleaning unit, and gradually adhere to a surface of the charging member that is located downstream the cleaning unit. Further, the paper powder, the toner, and dust, floating in the image forming apparatus, also gradually adhere to the surface of the charging member, and change the electric resistance of the charging member as the charging member is used for a long time to induce the abnormal image.

To cope with the abnormal image, for example, Japanese Patent Application Laid-Open No. HEI 8-123140 discloses a charging device that removes the foreign substances from the surface of the charging member by pressing a pad-shaped material onto the member.

Further, Japanese Patent Application Laid-Open No. HEI 11-288150 discloses a charging roller cleaning unit provided with a flexible member. The charging roller cleaning unit cleans a surface of the charging roller by a surface contact of the flexible member with the charging roller.

However, according to Japanese Patent Application Laid-Open No. HEI 8-123140, the pad-shaped material is pressed onto the charging member capturing the foreign substances. If the foreign substances include the toner or other additives, the substances are rubbed against the charging member. If the charging member is used for a long time, a sheet of thin film is formed on the charging member by effects of a press and a frictional heat. Thus, the thin film can damage a charging function of the charging member. Further, it is difficult to keep an effectiveness of a cleaning effect of the pad for a long period of time, because a contact area of the pad with the charging member that actually contributes to the cleaning of the charging member is small. One idea is to increase the contact area of the pad with the charging member is to make the pad larger. However, this idea has a disadvantage such that the image forming apparatus is upsized. Further, according to the Japanese Patent Laid-Open No. HEI 11-288150, a contact area of a cleaning unit for charging member that actually contributes to the cleaning of the charging member is small, thereby, a cleaning ability of the cleaning flexible member is not maintained for a long time. Furthermore, the main body of the image forming apparatus is provided with an intermediate transfer body, and therefore the photoreceptor does not contact the transfer paper directly. Thus, it is advantageous that quantity of the paper powder adhering to the transfer paper and reaching the charging member through the photoreceptor is small. This is disadvantageous, however, for a full color image forming apparatus in which the uneven charging tends to be conspicuous, because only one photoreceptor is provided for developing units of plural colors, and because the paper powder, though small in quantity, reaching the charging member through the intermediate transfer body and the photoreceptor, accumulates on one charging member.

SUMMARY OF THE INVENTION

The present invention has been achieved in order to solve the above-mentioned problems, and it is an object to provide an image forming apparatus capable of preventing stains on the charging roller, caused with the lapse of time, using an inexpensive mechanism. It is another object of the present invention to provide an image forming apparatus capable of prolonging lives of cleaning units and charging members, using an inexpensive mechanism.

The image forming apparatus according to the present invention, comprises a plurality of image carriers that carry toner images; an intermediate transfer body through which the toner images carried by the image carriers are transferred onto a recording medium; a plurality of charging members provided in contact with or adjacent to the image carriers, respectively, and a cleaning unit that is in contact with at least one of the changing member and removes foreign substances from a surface of the changing member.

The other objects, features and advantages of the present invention are specifically set forth in or will become apparent from the following detailed descriptions of the invention when read in conjunction with the accompanying drawings.

DETAILED DESCRIPTIONS

An exemplary embodiment of the present invention will be explained below with reference to the accompanying drawings.

Figure 1:
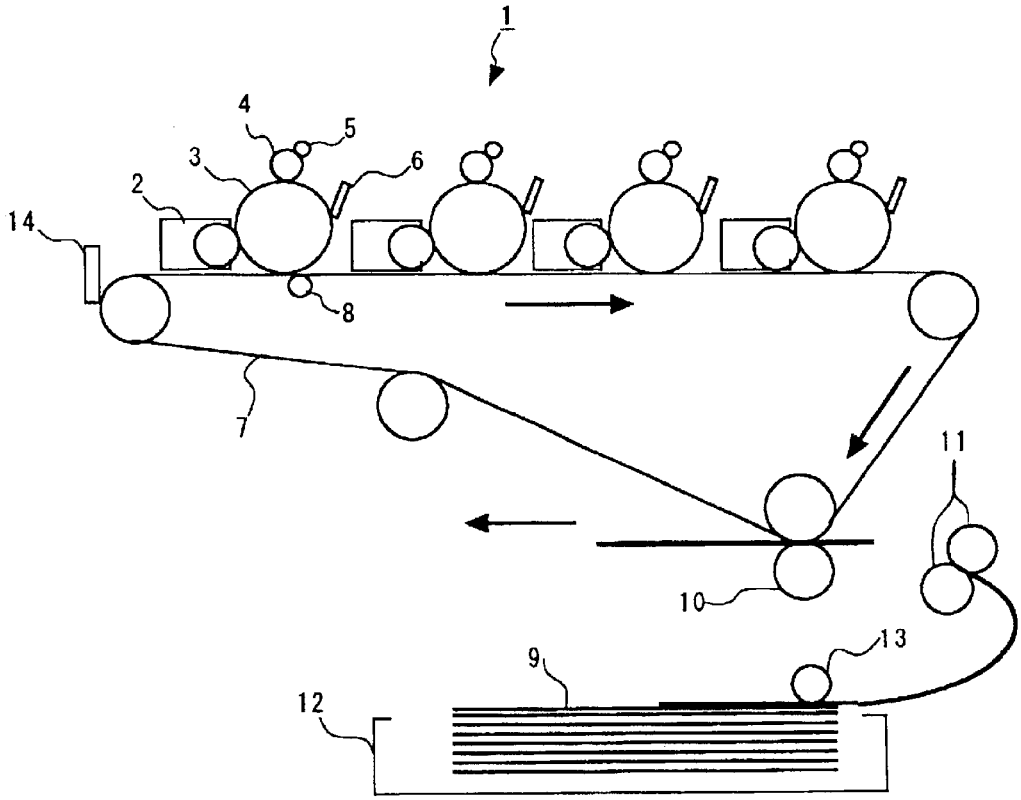
FIG. 1 shows a schematic view of a structure of an image forming apparatus according to an embodiment of the present invention.

FIG. 1 shows a schematic view of a structure of an image forming apparatus according to the embodiment.

An image forming apparatus comprises four sets of each following units, photoreceptors 3 as an image carrier, developing units 2, charging members 4, charging members cleaning members 5, and photoreceptor cleaning units 6. Each of the developing units 2 is provided with four color toners, black, yellow, magenta, and cyan, enabling the developer to full color print. A toner image visualized on the photoreceptor 3 using a known process is transferred onto an intermediate transfer body 7 at a first transfer area that is in contact with or adjacent to the intermediate transfer body 7. The toner image on the intermediate transfer body 7 is transferred onto a transfer paper 9 at a second transfer area that is in contact with or adjacent to a second transfer member 10, thereafter fixed by a fixing unit which is not shown.

The transfer paper 9 is sent to a pair of registration rollers 11 by a paper feeding roller 13 from paper feeding cassette 12, and conveyed to a second transfer process area at a prescribed timing. Paper powder generated by frictions at the paper feeding roller 13 or registration rollers 11, and a portion of paper powder adhering to the transfer paper 9 generated in a paper cutting process adheres to the intermediate transfer body 7 at the second transfer area. Even though the paper powder on the intermediate transfer body 7 is removed by a cleaning unit 14, a portion of the paper powder passes through the cleaning unit 14, and adheres to the photoreceptors 3 at the first transfer area. Even though the paper powder on the photoreceptor 3 is removed by the photoreceptor cleaning unit 6, a portion of the paper powder passes through the cleaning unit 6, adhering to and accumulating on the charging member 4. According to the structure of the present invention, some portion of the paper power on the transfer paper 9 moves to the intermediate transfer body 7, furthermore some portion of the paper powder on the transfer body 7 moves to the photoreceptors 3. Furthermore, the intermediate transfer body 7 is provided with the cleaning unit 14, and the transfer body 7 always touches the photoreceptor 3 after the paper powder is removed, thus, the transfer body 7 comes into contact with the photoreceptor 3 after the paper powder is adequately reduced. Therefore, the image forming apparatus according to the present invention can reduce the amount of the paper powder accumulating on the charging member 4 as compared to image forming apparatuses, according to the conventional technology, that are not provided with the intermediate transfer body 7. Furthermore, the image forming apparatus according to the present invention, the amount of the paper powder accumulating on the surface of one charging member 4 can be further reduced, because the paper powder from the intermediate transfer body 7 does not concentrate on one particular charging member 4, due to the fact that the apparatus is provided with four photoreceptors 3 and four charging members 4.

However, abnormal images occur due to faulty charging such as an uneven charging and an insufficient charging of the photoreceptor 3, because the paper powder gradually adheres to the charging member 4 with time, changing the electric resistance of the charging member 4.

Figure 2:
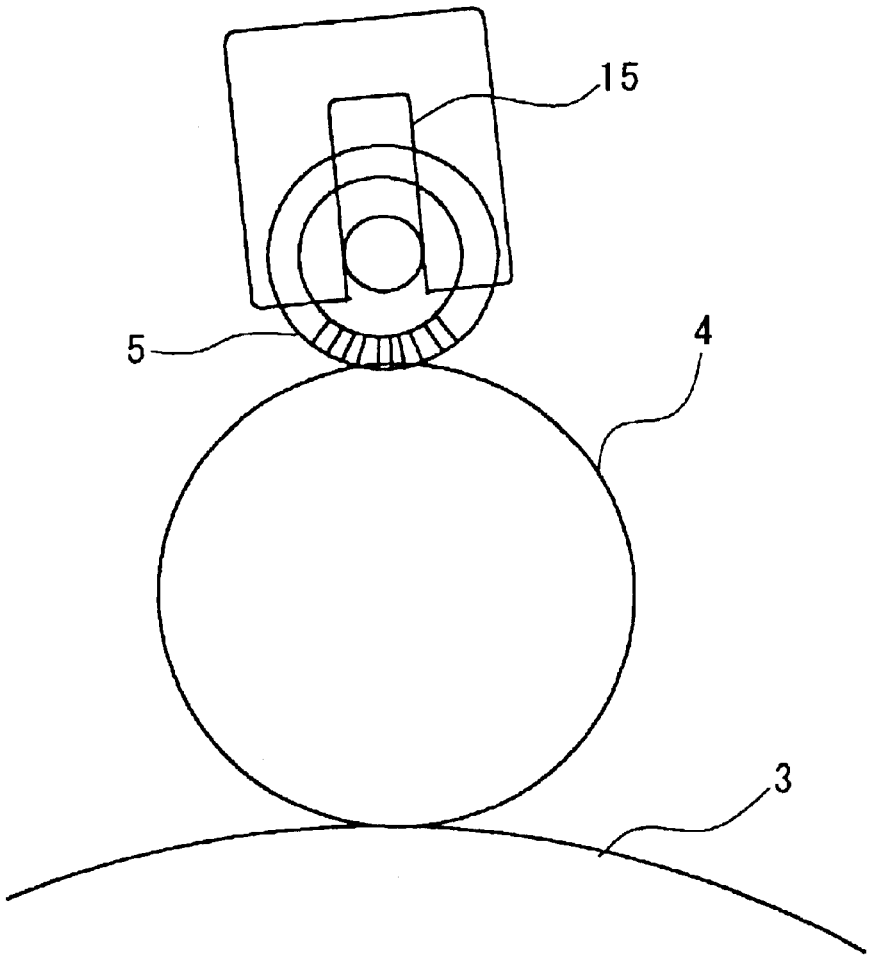
FIG. 2 shows a schematic view of a cleaning member for a charging member (hereinafter, "charging member cleaning member") of the image forming apparatus.

FIG. 2 shows a schematic view of the charging member cleaning member used for the image forming apparatus of the present invention.

The cleaning member 5 for the charging member is a roller-shaped brush. All over the circumferential surface of the brush contributes to cleaning, therefore, an area of the brush capable of cleaning becomes larger and the brush keeps a cleaning ability for a longer period of time in comparison with areas and abilities of the pad-shaped cleaning members such as foamed elastomer and felt. Further, a smaller brush keeps longer cleaning ability than a larger pad-shaped cleaning member.

The charging member cleaning member 5 is guided toward a designated direction by a guide 15 and contacts the surface of the charging member 4 by an own weight of the cleaning member 5, and follows the rotation of the charging member 4. A pressure force of the cleaning member 5 toward the charging member 4 is set by the own weight of the brush, and therefore there is no need to provide a part that controls how the brush is engaged in the charging member 4, thus enabling cost cutting. It is desirable to keep the length of the brush bristles as short as 2 mm or less so as to reduce a quantity of an elastic deformation of brush fibers, preventing the brush fibers from falling down for a long period of time.

Further, as the brush follows the rotation of the charging member 4, no driving unit is needed, thus exerting intended effects economically. By intentionally providing a difference in moving speed between the brush and the charging member using, for example, a gear (not shown), a cleaning effect may be improved by positively scratching the surface of the charging member 4.

Figure 4:
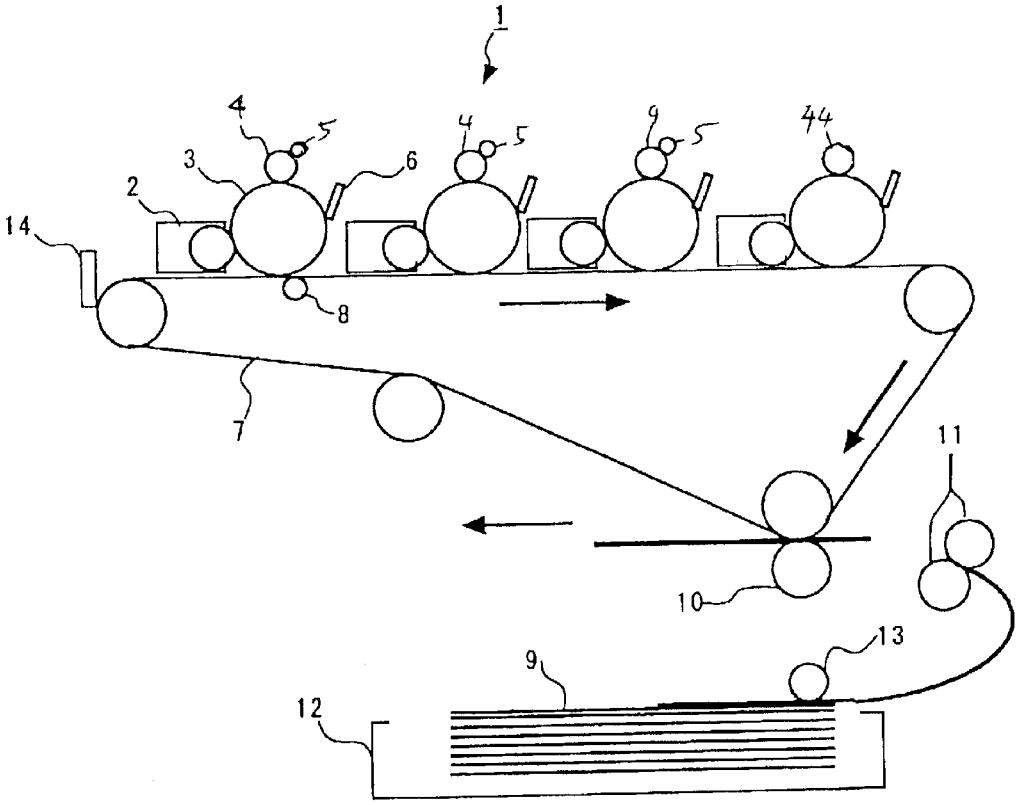
FIG. 4 shows a schematic view of another structure of the image forming apparatus in which one of charging members is not provided with the charging member cleaning member but the other charging members are provided with the charging member cleaning members.

Although in FIG. 1, all the charging members 4 are provided with the cleaning member 5, but the cleaning member 5 may not always be necessary. FIG. 4 shows a schematic view of another structure of the image forming apparatus in which one of the charging members is not provided with the charging member cleaning member but the other charging members are provided with the charging member cleaning members. As shown in FIG. 4, a charging member 44 is not provided with the cleaning member 5, though the other charging members 4 are provided with the cleaning members 5. The rest of the components of the image forming apparatus shown in FIG. 4 is substantially the same as those of the apparatus shown in FIG. 1.

In the image forming apparatus having the intermediate transfer body 7, the amount of paper powder coming in to the photoreceptor 3 is extremely little. Further, most portion of the paper powder existing on the intermediate transfer body 7 transfers onto the photoreceptor 3 that is disposed upstream in the moving direction of the intermediate transfer body 7. The paper powder exists little on the intermediate transfer body 7 downstream of the photoreceptor 3. Therefore, it is possible to exert an effect economically by providing the cleaning member 5 on only the charging member 4 that charges the photoreceptor 3 disposed at the utmost upstream in the moving direction of the transfer body 7. In the case of providing a plurality of the charging member cleaning members 5, it is desirable to allocate the cleaning members 5, in order from the upstream in the moving direction of the transfer body 7. Thus, if the amount of the paper powder coming in is extremely little, most portion of the powder adheres to the photoreceptor 3 disposed at the utmost upstream in the moving direction of the transfer body 7. Therefore, if the cleaning member 5 is provided on the photoreceptor 3 disposed at the utmost upstream, unnecessary cleaning member 5 can be eliminated. Thereby, cost cutting is realized and stains on the charging member 4 due to the paper powder can be prevented.

If types of toners used and conditions of bias applied to the charging members 4 are different in each station of the photoreceptors 3, it is predicted that adhesiveness of the foreign substances to the surface of the charging member 4 will differ accordingly. Therefore, the cleaning members 5 may be provided on the charging members in order from a charging member to which the substances are most easily adhered.

The foreign substances that adhere to the surface of charging member 4 include not only the paper powder but also some other substances. Various substances, such as the toner and toner additives of silica or titanium oxide that remain after cleaning by the photoreceptor cleaning unit 6, adhere and accumulate on the surface of charging member 4. Furthermore, various other substances such as floating dusts in the image forming apparatus 1 adhere to and accumulate on the surface of charging member 4. The foreign substances that are not captured by the cleaning unit 6 are not distributed evenly on the photoreceptor 3. Therefore, quantities of the foreign substances on the charging member 4 tend to become uneven along a longitudinal direction of the charging member 4. According to the present invention, both AC and DC voltages are applied by superposition to the charging member 4 from a power source (not shown). Thereby, it is possible to obtain a higher uniformity of a charging electric potential due to an effect of an AC voltage component as compared to the case where only DC voltage is applied. Thus, even if unevenness of the electric resistance of the charging member 4 occurs, unevenness of the charging electric potential can be made less conspicuous.

It is possible to further control adherence of stains to the surface of the charging member 4 by using a toner manufactured by the polymerization process for the toner stored in the developing unit 2. The foreign substances adhering to the surface of the charging member 4 include the toner that is not captured by the cleaning unit 6. The toner manufactured by the polymerization process raises a transfer efficiency in the electrostatic transfer process extremely high, because a charge-mass ratio among toner grains is extremely high in uniformity due to a homogeneity of surface of each toner. Thus, the quantity of the toner carried into the photoreceptor cleaning unit 6 becomes less than the quantity of conventional toners carried into the cleaning unit 6, and therefore the quantity of toner that is not captured by the cleaning unit 6 to adhere to the surface of the charging member 4 is reduced.

The quantity of toner adhering to the surface of the charging member 4 can be further reduced by making the shapes of the toner deformed instead of semi-perfect sphere, because the deformed toner is easier to be scratched off by the cleaning unit 6.

Figure 3:
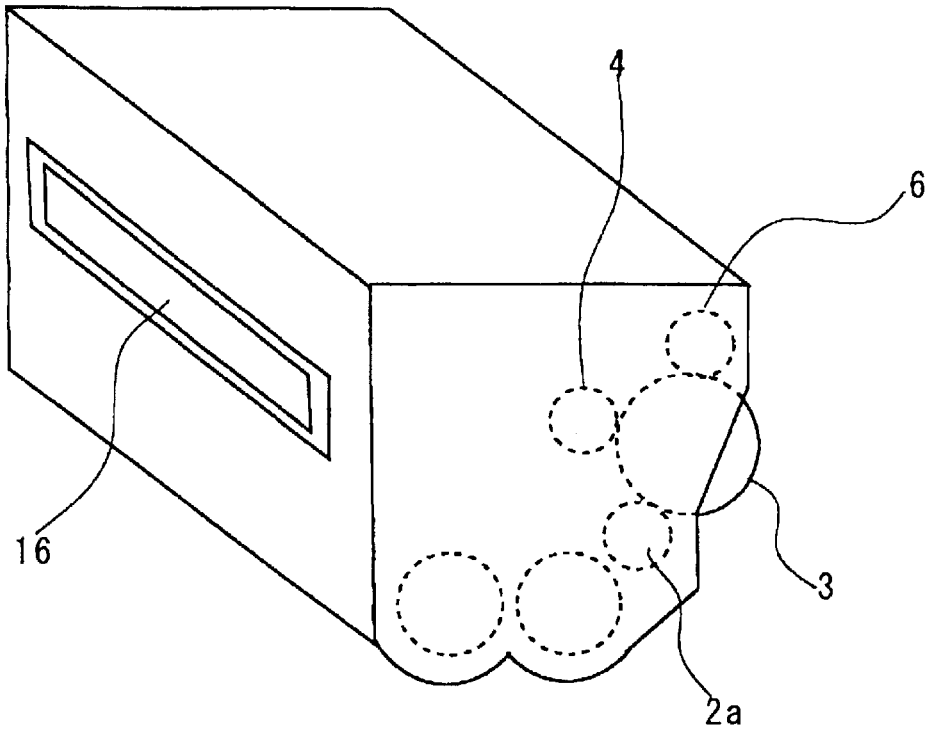
FIG. 3 shows a schematic view of a process cartridge used in the image forming apparatus.

FIG. 3 shows a schematic view of a process cartridge used in the image forming apparatus according to the present invention.

The respective structures described above may be integrated as the process cartridge. As shown in FIG. 3, if a space around the charging member 4 is roughly covered, chances of dusts, floating in the image forming apparatus 1, to contact the charging member 4 are reduced. Thus, adherence of stains to the charging member 4 is effectively controlled.

In FIG. 3, the photoreceptor 3, the charging member 4, a developing unit 2*a*, and the photoreceptor cleaning unit 6 are integrated into the process cartridge, and all parts other than a transferring portion are covered. An exposure unit is covered by a transparent material 16. In the embodiment, the entire cartridge is roughly covered, but only the space around the charging member 4 may be covered.

It is possible to make substantially longer a life span of the charging member 4 of which life span is short in a conventional process cartridge. It is possible to make a good use of a merit of the process cartridge without shortening a whole life span of the process cartridge that depends on the life span of the charging member 4.

As explained above, according to the present invention, the toner image on the photoreceptor is transferred to the transfer paper through the intermediate transfer body. Thus, the photoreceptor does not contact the paper directly. Therefore, the quantity of paper powder passing through the cleaning unit provided on the photoreceptor to accumulate on the charging roller reduces dramatically, thus realizing a longer life span of the charging member 4. Further, the number of the cleaning members for the charging members is reduced, thus enabling cost cutting.

Especially in the case of a full color image forming apparatus, toners of a plurality of colors are superposed on one another, and therefore, abnormal images have significantly occurred due to the uneven charging caused by a subtle uneven electric resistance of the charging roller due to the adherence of the foreign substances to the charging roller. However, the full color image forming apparatus is able to prevent the abnormal images from occurring by reducing the quantity of paper powder that accumulates on the charging roller.

The present document incorporates by reference the entire contents of Japanese priority document, 2002-110248 filed in Japan on Apr. 12, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of image carriers;

an intermediate transfer body configured to receive toner images from one or more of the plurality of image carriers and transfer the toner images onto a recording medium;

a plurality of charging members provided in contact with or adjacent to the image carriers, respectively; and a cleaning unit that is in contact with at least one of the charging member and removes foreign substances from a surface of the charging member.

2. The image forming apparatus according to claim 1, wherein if only one cleaning unit is provided, the cleaning unit is provided corresponding to a charging member located on the most upstream of a rotating direction of the intermediate transfer body, and if a plurality of the cleaning units are provided, the cleaning units are provided corresponding to a charging member located on the most upstream towards a charging member located on a downstream of the rotating direction.

3. The image forming apparatus according to claim 1, wherein if the cleaning unit is such that the cleaning unit makes a contact with the surface of a corresponding one of the charging member, then the cleaning unit is a brush.

4. The image forming apparatus according to claim 3, wherein the brush makes the contact with the surface of the charging member by its own weight and the brush rotates as the charging member moves.

5. The image forming apparatus according to claim 3, wherein the brush moves at a speed that is different from a speed at which the charging member moves.

6. The image forming apparatus according to claim 3, wherein the brush has a plurality of fibers that are 2 mm or less in length.

7. The image forming apparatus according to claim 3, wherein the charging members are provided in contact with or adjacent to the image carriers, and are applied with an AC voltage and a DC voltage by superposition.

8. The image forming apparatus according to claim 1, wherein a space at least around the charging member is substantially enclosed.

9. The image forming apparatus according to claim 1, wherein toner to be used is manufactured by a polymerization process.

10. The image forming apparatus according to claim 1, further comprising a process cartridge having at least the charging member and the cleaning unit for the charging member.

* * * * *